US005168735A

United States Patent [19]

Wang

[11] Patent Number: 5,168,735

[45] Date of Patent: Dec. 8, 1992

[54] KEY HOLDER

[76] Inventor: Philip Wang, No. 7, Kao-Cheng 9th Street, Pa-Teh Hsiang, Tao-Yuan Hsien, Taiwan

[21] Appl. No.: 799,991

[22] Filed: Nov. 29, 1991

[51] Int. Cl.[5] ..... A47G 29/10

[52] U.S. Cl. ..... 70/456 R; 70/457; 24/3 K; 206/37.5

[58] Field of Search ..... 70/456 R, 456 B, 457–459; 24/3 K; 206/38.1, 37.5, 37.6, 37.8

[56] References Cited

U.S. PATENT DOCUMENTS

| | | | |
|---|---|---|---|
| 2,657,568 | 11/1953 | Morrell | 70/456 R |
| 2,737,046 | 3/1956 | Jancsics | 70/457 |
| 3,257,696 | 6/1966 | Miller et al. | 70/456 R |
| 3,503,235 | 3/1970 | Field | 70/456 R |
| 3,608,343 | 9/1971 | Kimel | 70/456 B |
| 3,703,822 | 11/1972 | Elsenheimer | 70/456 B |
| 4,193,278 | 3/1980 | Martinez | 70/459 |
| 4,512,168 | 4/1985 | Reitze | 70/456 R |
| 4,584,858 | 4/1986 | Wolter | 70/456 R |
| 4,592,219 | 6/1986 | Richter | 70/456 R |

FOREIGN PATENT DOCUMENTS

| | | | |
|---|---|---|---|
| 720198 | 10/1965 | Canada | 70/456 R |
| 2572262 | 5/1986 | France | 70/456 R |

*Primary Examiner*—Renee S. Luebke
*Assistant Examiner*—D. M. Boucher
*Attorney, Agent, or Firm*—Wenderoth, Lind & Ponack

[57] ABSTRACT

An improved disc-type key holder includes a circular disc with an annular sliding groove on its peripheral surface, and a multiplicity of key retaining rings slidably suspended in the groove. The disc is formed of two halves each having in the center of the disc surface a boss portion with a recess on the outside and a convexity on the inside and which are opposedly joined together to form a wheel-type body. On the disc surface of one of the two halves is provided a guide slit cutting and extending along the surface from a point on the peripheral wall toward the center to terminate in an enlarged end opening provided on the peripheral surface of the boss portion.

10 Claims, 7 Drawing Sheets

KEY HOLDER

BACKGROUND OF THE INVENTION (1.) Field of the Invention

The present invention relates to a key holder, and more particularly to a disc-type key holder, comprising a disc having on the peripheral surface thereof an annular groove and a plurality of key retaining rings capable of sliding and being detachably held in the groove by stud pins.

(2.) State of the Prior Art

In the prior art, as represented in FIG. 15, the key holder comprises a disc member 10 having on a circumferential surface an annular groove 101 and on a lateral surface thereof a radial guide slot 102, a stop pin 20 accommodated in a radial sliding hole 103 formed in the annular groove 101 and passing through the center of the circle and communicating with the guide slot 102, a spring 30 similarly received in the interior of the sliding hole 103 to constantly push the stop pin 20 toward the outside, an operating knob 40 having an inner end passing through the guide slot 102 to be screwed to the stop pin 20 and an outer end extending out of the guide slot 102 for restricting the range of movement of the stop pin 20 to thereby limit the stop pin 20 to radial sliding movement and a plurality of key holder rings 60 slidably and detachably retained in the annular groove 101 by means of stud pins 50 and in cooperation with the stop pin 20.

The conventional key holder has many advantages and has been popularly used. The keys retained therein are easy to organize, to add on or to remove, or to select for use, and the keys do not get hooked up with each other. However, because of the large number of parts, it is laborious and time-consuming to manufacture and assemble. Also, because of high costs, it has not been possible for large-scale production at low prices. These facts have been drawbacks for this type of key holder. For instance, in this type of key holder metals have been used, such as copper being turned for the circular disc 10 with a lathe. A milling machine mills off the annular groove 101 and the guide slot 102, and the sliding hole 103 is drilled with a drilling machine. The stop pin 20 is first turned with the lathe and then milled with a milling machine to mill of a notch 201 and also to drill out a hole 202 for accommodation therein off the spring 30. In turn, the operating knob 40 has to be turned to be threaded, and in addition to the above, all the parts have to be subjected to surface treatments like electroplating. All these factors have been the cause for high costs and inefficiency in production.

SUMMARY OF THE INVENTION

Accordingly, the aim of the present invention is to eliminate the afore-mentioned drawbacks by providing an improved key holder with a smaller number of parts, that is easy to manufacture and assemble, and which has a low cost and is suitable for large-scale production, while at the same time possessing the same effectiveness as the conventional disc-type key holder.

With this aim in view, according to the present invention there is provided a disc-type key holder having a circular disc formed merely of two metal sheets punch pressed into two circular halves. The two circular halves are subsequently joined by appropriate techniques such as spot welding to form a single body. The circular disc halves have none of the indispensable accessory parts of the conventional key holder, such as a stop pin, control knob, spring, etc. because there is no need for processing by lathe turning, milling of the grooves, drilling, etc., the cost has been greatly reduced and the key holder has also become suitable for automatic production on a large scale.

It is a further object of the present invention to provide a disc-type key holder having a circular disc which may be formed by joining of two circular halves of thermoplastic material, or by powder metallurgy or die casting, to form a single body by means of, fusion welding for example, or supersonic welding, and which, as a result, may also be produced on a large scale at the same low price as those made of metal sheets.

It is yet another object of the present invention to provide a disc-type key holder having on the side of a circular disc where a slit is present a rotatably mounted plate provided with a slit corresponding to the slit on the circular disc for exit and entry of key studs, thereby preventing key rings from falling off accidentally.

BRIEF DESCRIPTION OF THE DRAWINGS

The present invention will best be understood from the following specification when taken in connection with the accompanying drawings, wherein.

DETAILED DESCRIPTION OF PREFERRED EMBODIMENTS OF THE INVENTION

Figure 1:
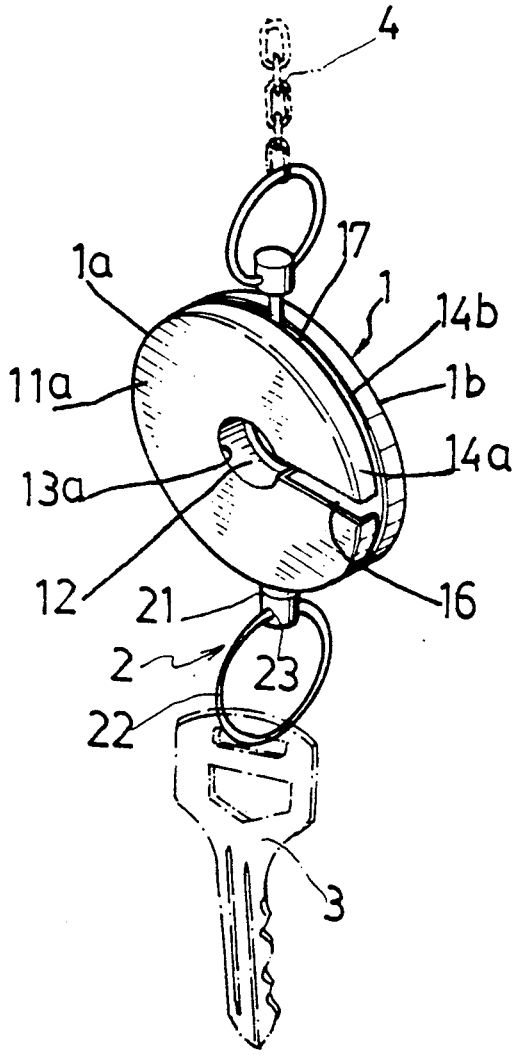
FIG. 1 comprises a perspective view of an embodiment of a disc-type key holder constructed in accordance with the principles of the present invention.
Figure 2:
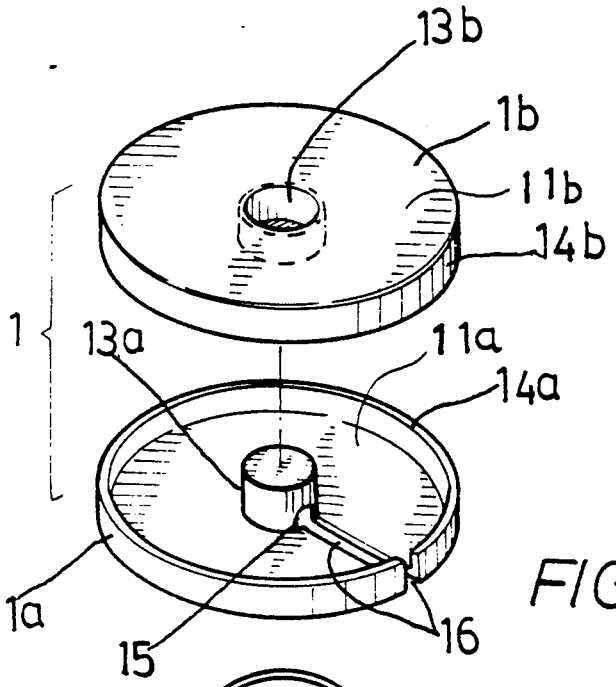
FIG. 2 is an exploded perspective view of the key holder disc in the embodiment of FIG. 1.
Figure 3:
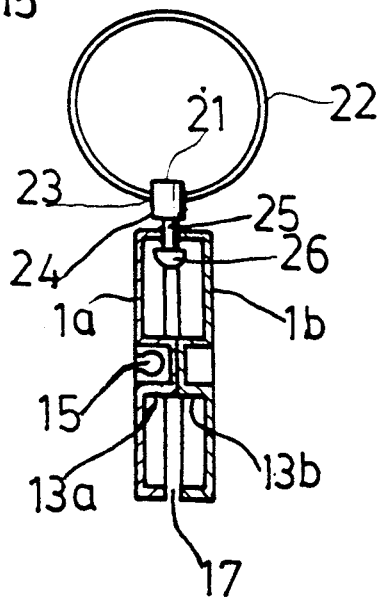
FIG. 3 is a longitudinal sectional view of the key holder disc in the embodiment of FIG. 1.

Referring now to FIGS. 1 through 3, the disc-type key holder of the present invention comprises a circular disc 1 and a plurality of key retaining members 2 detachably held on the periphery of the disc 1.

The disc 1 is formed of two metal sheets, preferably of stainless steel sheet, which, after being punched into two circular halves 1*a* an 1*b* by a punch press, are oppositely joined to each other to form a wheel-shaped body by spot welding, riveting or any other appropriate method. One of the disc halves for example, 1*a*, forms a circular body having on a front central part of the disc face 11*a* a cylindrical recess 12 and on the back side a projecting boss portion 13*a* and is also provided on its circumference with a circumferential wall 14*a* having a height lower than that of the boss portion 13*a*. Next, on the disc face 11*a* of the half 1*a* is defined a radial guide slit 16 cut from a portion on the circumferential wall 14*a* and extending radially along the disc face 11*a* into a terminal end behind the root of the boss portion 13*a*, and continuing towards the circumferential surface of the boss portion to end in an enlarged hole 15. The other disc half 1*b* also forms a circular body substantially similar to the disc half 1*a*, having on its center a boss portion 13*b* lower than the above boss portion 13*a*, a disc face 11*b* without a guide slit, and having formed on the circumference of the disc face 11*b* a circumferential wall 14*b* corresponding to the above circumferential wall 14*a*. The sum of heights of the two boss portion 13*a*, 13*b* is greater than that of heights of the two circumferential walls 14*a* and 14*b*, so that when the two disc halves 1*a* and 1*b* are joined together to form a single body by the top surfaces of the two boss portions 13*a* and 13*b* by application, for example, of spot welding. There is then suitably formed in between the two circumferential walls 14*a* and 14*b* on the circumferences thereof a gap forming an annular sliding groove 17 for the key retaining members 2 to be hung slidably along the sliding groove 17 by means of stud pins 21, which will be described herein later.

The key retaining member 2, as in the conventional key holder, is comprised of a stud pin 21 and a ring 22. The stud pin 21, in turn, consists of a column end 24 provided thereon with a hole 23 for passing through and retaining therein the ring 22, a smaller diameter rod-like neck 25 having one end connected to the column end 24 and a larger diameter head 26 connected to one end of the neck 25. In the present embodiment, the head 26, as shown in FIG. 3, is about semispherical in shape. However, the head 26 may also be formed in a spherical shape (FIG. 5) or a cone-head shape (not shown) or in any other suitable shape.

In the embodiment of the present invention, the internal diameter of the recess 12 in the disc half 1*a* and the diameter of the terminal hole 15 of the guide slit on the shaft cylinder 13*a* must be larger than the diameter of the head 26 of the stud pin 21. Next, the width of the guide slit 16 and of the annular groove 17 must also be slightly larger than the diameter of the neck 25 of the stud pin 21 and smaller than the diameter of the head 26 and of the column end 24 so that the stud pin 21 is movably retained in the annular sliding groove 17 and will not drop off. In the drawings, those parts indicated by the dotted lines are a key 3 and a chain 4.

Figure 4:
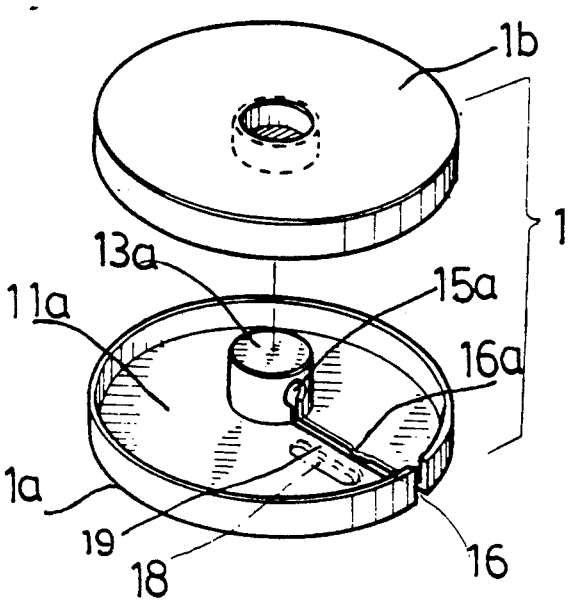
FIG. 4 is a perspective view of a key holder disc in a second embodiment of the present invention.
Figure 5:
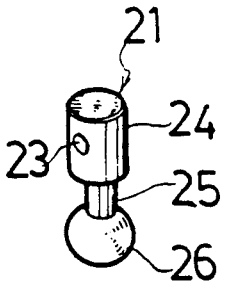
FIG. 5 is a front view of another modification of the stud pin used in the present invention.

FIGS. 4 and 5 illustrate a second embodiment of the present invention. This embodiment is basically similar to the above described first embodimetn, differing merely in in order that the disc 1 cooperates with the use of the stud pin 21 of a spherical head 26, the hole 15 on the boss portion 13*a* is configured as a keyhole shape. In order that the stud pin 21 does not drop off easily, the guide slit 16 is formed at any one place located on the disc surface 11*a* with a slightly narrow throat 16*a*. In other respects, this embodiment is completely the same as the above embodiment. In the present construction, when a stud pin 21 is to be mounted or removed, this can be attained by the application of a slight force to push the neck 25 past the throat 16*a* against the resilience possessed by the disc 1*a*, and thus the stud pin 21 will be even more secured and will not drop off accidentally. Furthermore, in order to increase the resilient force on one side of the guide slit 16, there may also be defined on any one side of the guide slit 16 an elongated hole 18 as shown by a dotted line, so that the strip like portion 19 between the guide slit 16 and the elongated hole 18 appropriately forms a resilient portion, whereby it is easier to force the stud pin 21 past the throat 16*a*. However, with this configuration with the disc surface provided with a hole 18, there will be an affect on the outer appearance of the key holder.

Figure 6:
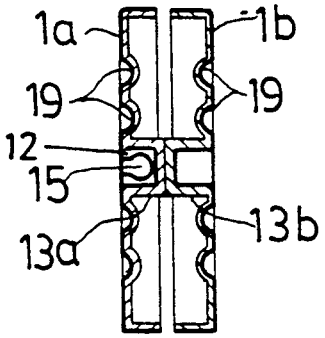
FIG. 6 is a plan view of a key holder disc in a third embodiment of the present invention.
Figure 7:
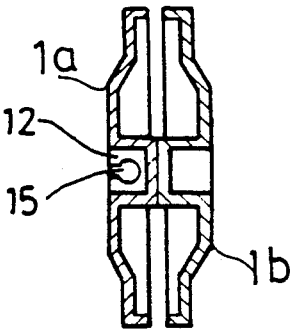
FIG. 7 is a sectional view of a key holder disc in a further embodiment of the present invention.
Figure 8:
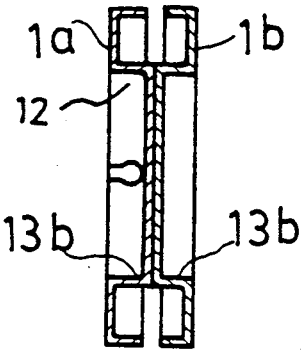
FIG. 8 is a sectional view of a key holder disc in a fifth embodiment of the present invention.
Figure 9:
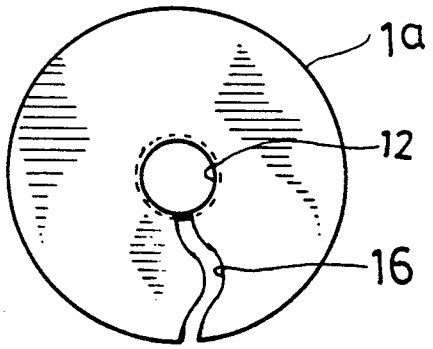
FIG. 9 is a sectional view of a key holder disc in a sixth embodiment of the present invention.

FIG. 6 shows a third embodiment of the present invention, in which, for enhancing the strength of the disc 1, each of the disc halves 1*a* and 1*b* is formed on the disc surface with annular reinforcement ribs 119. FIG. 7 shows a fourth embodiment of the present invention, in which the disc 1 is formed in a section shape slightly different from that of the foregoing embodiments in section. FIG. 8 illustrates a fifth embodiment of the invention, in which the diameters of the boss portions 13*a* and 13*b* of the disc 1 are enlarged to allow the annular space in the head 26 of the stud pin 21 to be reduced to the minimum. FIG. 9 shows a sixth embodiment of the present invention, in which the guide slit 16 of the disc 1 is formed in a curved shape to allow the stud pin 21 to be still further secured from dropping off.

Figure 10:
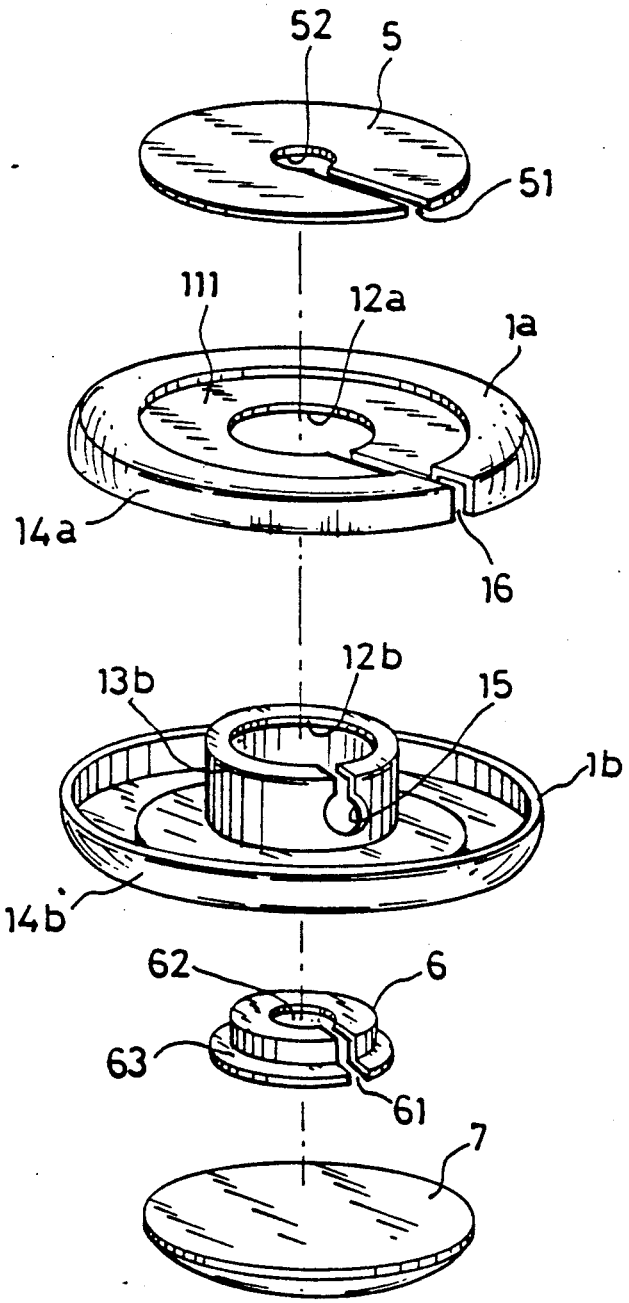
FIG. 10 is an exploded perspective view of a key holder disc in a seventh embodiment of the present invention.
Figure 11:
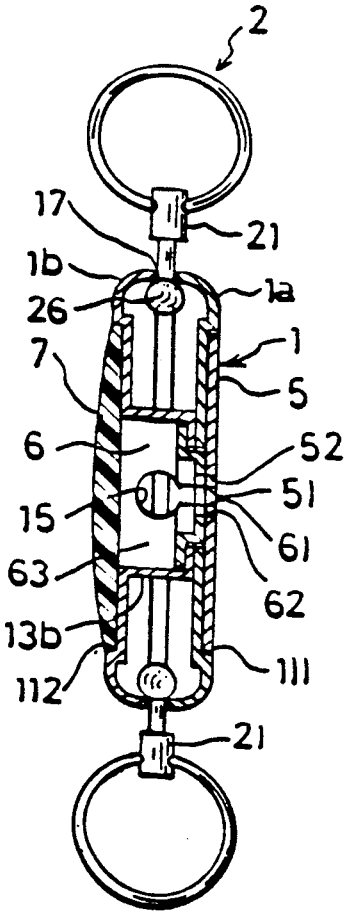
FIG. 11 is a longitudinal sectional view of a key holder disc in the embodiment of FIG. 10.

FIGS. 10 and 11 illustrate a seventh embodiment of the present invention in which, the constitution of the key holder is basically the same as those of the above embodiments. However, in order to keep the stud pin 21 more securely from falling off accidentally, a rotatable disc 5 is provided on the outer surface of the disc half 1*a* to cover the guide slit 16. Particularly, the outer surface of the disc half 1*a* is formed with a circular depression or recess 111, in the center of which is a circular hole 12*a* acting as the recess 12 and communicating with the guide slit 16. The outer surface of the disc half 1*b* is also formed with a circular depression 112, from the center of this depression is projected a cylindrical boss portion 13*b* which has in its center a round hole 12*b* corresponding to the circular hole 12*a* and on a circumferential wall a keyhole type hole 15. The two disc halves 1*a* and 1*b* are joined together to form a single body spot welding together by the annular top surface of the boss portion 13*b* and the bottom surface of the recess 111. After the two disc halves 1*a* and 1*b* are joined, the round holes 12*a* and 12*b* become overlapped as a single hole, and the hole 15 also communicates with the guide slit 16. On the rotatable disc 5 are formed a radial guide slit 51 corresponding to the guide slit 16 and a central hole 52 communicating with one end of the slit 51. This rotatable disc 5 is provided on its bottom with a cylindrical member 6 having a flange portion 63, and a hole 62 and a slit 61, corresponding respectively to the hole 52 and the guide slit 51, and connected thereto by spot welding. The rotatable disc 5, by means of the cylindrical member 6, passes through the holdes 12*a* and 12*b*, and the flange portion 63 is locked on the inner side of the annular upper face of the boss portion 13*b*, and with the member 6 as a shaft, is rotatably retained in the recess 111. Under this arrangement, it is possible to remove the stud pin 21 from or mount it back onto the key holder in the same manner as in the previous embodiments when a coin is inserted in the slit 51 to rotate the rotatable disc 5 and allow the slit 51 to superimpose with the slit 16. Thereafter, when the rotatable disc 5 is turned a further angle to allow the slit 51 to be out of alignment with the slit 16, that is, to allow the disc 5 to close up the slit 61, the stud pin 21 is secured and will never fall off. Furthermore, is attached by an adhesive or any other means round cover plate 7 in the recess 112 of the disc half 1*b*; to seal off the outwardly directed opening of the boss portion 13*b*.

Figure 12:
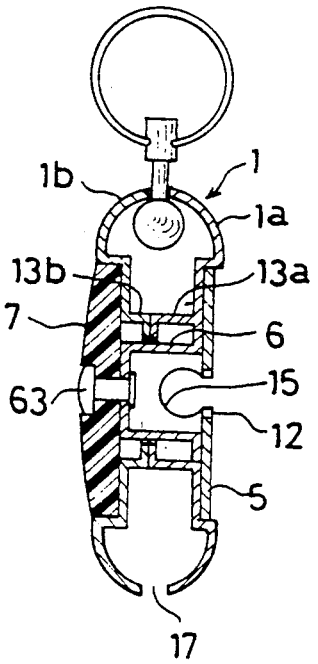
FIG. 12 is a longitudinal sectional view of a key holder disc in an eighth embodiment of the present invention.

FIG. 12 shows an eighth embodiment of the present invention, in which the basic constitution is the same as that of the seventh embodiment. However, the two disc halves 1*a* and 1*b* are like those illustrated in the first embodiment, each having a boss portion 13*a* and 13*b*, respectively, to be welded together face to face. Also, the rotatable disc 5 is provided by welding it with a cylindrical member 6 acting as the tubular shaft. One end of the cylindrical member 6, extended into the recess 112 after passing through the overlapping holes 12*a* and 12*b* of the two boss portions 13*a* and 13*b* is joined by a suitable connecting means, such as a rivet 63, to the cover plate 7 to form a single body. The disc 5 and the cover plate 7 then become rotatable with the cylindrical member 6 as the axis. Therefore, the rotatable disc 5 can be rotated by turning the cover plate 7 to achieve the purpose of opening and closing of the guide slit 16.

Figure 13:
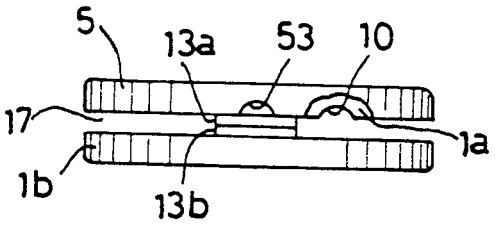
FIG. 13 is a plan view of a key holder disc in a ninth embodiment of the present invention.
Figure 14:
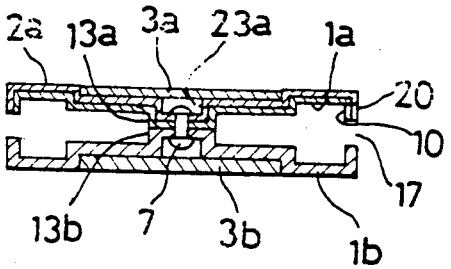
FIG. 14 is a sectional view of the key holder disc in the embodiment of FIG. 13.
Figure 15:
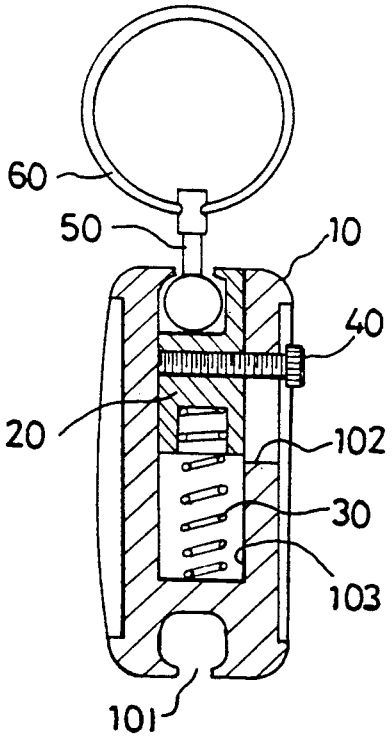
FIG.15 (PRIOR ART)
FIG. 15 is a sectional view of a prior art disc-type key holder.

FIGS. 13 and 14 illustrate a ninth embodiment of the present invention, in which the key holder, like that of the seventh and eighth embodiments, consists of two disc halves 1*a* and 1*b*, a rotatable disc 5, a cylindrical member 6 and a cover plate 7. The rotatable disc 5 is, however, formed of a shape appropriately overlapping the disc half 1*a* and is rotable on the disc half 1*a* with the cylindrical member 6 as the axis. In the present embodiment, no radial guide slits 16 and 51 are provided on the surfaces of the disc half 1*a* and the rotable disc 5. Also, the boss portion 13 is not defined with a hole 15. Instead, the disc half 1*a* and the rotable disc 5 are formed on their circumferential walls, respectively, with overlappable semicircular notches 10 and 53. These two notches 10 and 53, as shown in FIG. 13, normally are kept at a staggered position in order to ensure that the annular groove 17 has an equal circumferential groove width to prevent the stud pin 21 from falling off. However, when the rotatable disc 5 is turned and the two notches 10 and 53 overlap each other, the two notches 10 and 53 are then in communication with the sliding groove 17, and the added width of which becomes an opening to allow the entry or exit of the head 26 of the stud pin 21 (see FIG. 14). In a nutshell, in the present embodiment the radial guide slits 16 and 51 of in the seventh and eighth embodiments have been extremely shortened to just the notches 10 and 53 located on the circumferential walls, while the rest of the structure remains the same as that of the previous embodiments.

In the foregoing embodiments, the disc is formed by punching a metal sheet material. It is to be noted, however, that the same structure may also be formed by thermoplastic material by injection molding or from a powder metallurgy by pressure molding or from a fusion alloy by die casting. When two disc halves 1*a* and 1*b* are formed, they are then joined together to form a single disc body by means of spot welding or supersonic welding or any other mechanical joining techniques, such as threaded connections, riveting, etc. Furthermore, in the foregoing embodiments, the guide slit 16 is located on one side of the disc 1. However, a guide slit may also be formed on both sides of the disc 1.

With the key holder configured as above, when it is desired to mount the key retaining member 2 on to the disc 1, the column end 24 of the stud pin 21 is held with the hand and the neck 25 is axially placed within the recess 12 of the boss portion 13*a* or the hole 52 of the rotatable disc 5 at a place opposite that of the hole 15. While maintaining that position, the head 26 is next moved into the hole 15 and thereafter the neck 25 is engaged in the guide slit 16 and moved along the slit toward the side of the circumference of the disc till the head 26 touches the circumferential wall at 14*b*, Then the head 26 is turned 90° to allow the neck 25 to enter the annular sliding groove 17 from the end of the slit 16 on the circumferential wall 14*a* and the head 26 is received within the sliding groove 17. In this way, the entire key retaining member 2 is capable of freely sliding along the circumference of the disc 1 by the movement of the neck 25 of the stud pin 21 in the sliding groove 17 and will not drop off due to the engagement of the ball head 26 and the column end 24 on the outer part in the sliding groove 17. When it is desired to remove the key retaining member 2, this may be done by reversing the operation according to the above disclosed fitting.

Since the key retaining rings 2 have to be removed from the circular disc 1, it must be emphasized here that the following requirements, at least, need to be satisfied in order to achieve the purpose, and these requirements are: 1) that the neck 25 of the stud pin 21 is aligned with the opening of the guide slit 16, 2) that the neck 25 is moved into the opening and is turned 90°, 3) that the stud pin 21 is moved along the guide slit 16 to the side of boss portion 13*a*, 4) that the stud pin 21 is adjusted so that the head 26 is aligned with the exit hole 15, and 5) that when the head 26 together with the neck 25 is moved into the recess 12 of the boss portion 13*a*, it is then radially pulled out, so that whenever the key holder is being carried along or is in use there will never be any likelihood that the key retaining members 2 drop off accidentally.

Configured as above, the key holder of the present invention is simple in construction and has fewer parts. The production is easy and the cost is low, the key holder is particularly suitable for automatic production at a large scale, and forms therefore a practically valuable item.

I claim:

1. A key holder, comprising:

a disc comprising two disc halves, a first said disc half having at the center thereof a boss portion defining a recess on one side of said disc half and a convex portion on the other side of said disc half, and a second said disc half being joined to the first said disc half on the surface of said convex portion of said boss such that a circumferential annular sliding groove is defined therebetween, one of said disc halves having a guide slot therein extending from said annular sliding groove toward the center thereof, said guide slot terminating in an enlarged end opening;

a disc plate member having a radial guide slit rotatably mounted on said disc; and a plurality of key retaining rings each having a stud pin for slidable and suspended engagement with said annular sliding groove.

2. The key holder of claim 1, wherein said disc plate member is rotatably disposed on said disc half having said guide slot therein such that said disc plate overlaps said guide slot and is capable of being rotated to align said radial guide slit and said guide slot for exit and entry of said stud pins and to misalign said radial guide slit and said guide slot to prevent accidental exit of said stud pins.

3. A key holder, comprising:

a first circular disc half having a peripheral portion;

a second circular disc half having a peripheral portion, said second disc half being fixed to said first disc half concentrically such that said peripheral portions are spaced apart and define an annular sliding groove therebetween, said second circular disc half having a first opening therein adjoining said annular sliding groove;

a disc plate having a second opening therein at a peripheral portion thereof rotatably mounted to said first and second disc halves; and a plurality of key retaining rings each having a stud pin for slidable and suspended engagement with said annular sliding groove, said pins being moved to and removed from said annular sliding groove through said first and second openings when said openings are aligned.

4. The key holder of claim 3, wherein both said second disc half and said disc plate have a central aperture and said first and second openings extend from said peripheral portions to said central apertures.

5. The key holder of claim 4, wherein said second disc half has a recess receiving said disc plate therein.

6. The key holder of claim 4, wherein said first circular disc half has a central boss portion with a central aperture, said boss portion is fixed to said second disc half about said central aperture of said second disc half, and a slot having an enlarged end opening is formed in said boss portion communicating with said first opening of said second disc half.

7. The key holder of claim 6, wherein a flanged cylindrical member extends through said boss portion and said second disc half and is connected to said disc plate to rotatably mount said disc plate on said disc halves and a cover plate is connected to said flanged cylindrical member.

8. The key holder of claim 4, wherein both said first and second disc halves have boss portions fixed to each other, said first disc half also having a central aperture.

9. The key holder of claim 8, wherein said disc plate member has a cylindrical member fixed thereto extending through said central apertures of said disc halves and connected to a cover plate to pivotably mount said disc plate member to said disc halves, an enlarged end opening being formed in said cylindrical member communicating with said second opening in said disc plate member.

10. The key holder of claim 3, wherein said peripheral portions of both said disc plate member and said second disc half comprise circumferential wall portions extending to said annular sliding groove, and said openings comprise semicircular notches of the same size.

* * * * *